US006119772A

United States Patent [19]

Pruet

[11] Patent Number: 6,119,772

[45] Date of Patent: Sep. 19, 2000

[54] CONTINUOUS FLOW CYLINDER FOR MAINTAINING DRILLING FLUID CIRCULATION WHILE CONNECTING DRILL STRING JOINTS

[76] Inventor: Glen Pruet, 2301 Christine, Pampa, Tex. 79065

[21] Appl. No.: 09/008,389

[22] Filed: Jan. 16, 1998

Related U.S. Application Data

[60] Provisional application No. 60/052,911, Jul. 14, 1997.

[51] Int. Cl.[7] ..... E21B 33/02

[52] U.S. Cl. ..... 166/81.1; 175/215

[58] Field of Search ..... 175/218, 207, 175/209, 215; 166/322, 325, 81.1

[56] References Cited

U.S. PATENT DOCUMENTS

| | | | |
|---|---|---|---|
| 2,214,429 | 9/1940 | Miller | 166/81.1 |
| 2,224,657 | 12/1940 | Rodgers | 166/81.1 X |
| 2,505,282 | 4/1950 | Endsley | 166/81.1 |
| 2,522,444 | 9/1950 | Grable | 166/81.1 |
| 2,610,690 | 9/1952 | Beatty | 166/81.1 |
| 3,559,739 | 2/1971 | Hutchison | 166/81.1 X |
| 4,315,553 | 2/1982 | Stallings | 175/218 X |
| 5,857,518 | 1/1999 | Vinson, Sr. | 166/81.1 |

*Primary Examiner*—Frank Tsay
*Attorney, Agent, or Firm*—Gunn & Associates, PC

[57] ABSTRACT

Apparatus and methods are disclosed for maintaining drilling fluid circulation while attaching joints of pipe to a drill string during the operation of drilling a well borehole. A chamber is clamped over a thread joint connecting two joints of drill string pipe. An inlet valve is opened to flow drilling fluid into the chamber under pressure. The thread joint is then broken, the chamber is partitioned with a ram thereby forming an upper and lower sub chambers, and drilling fluid circulation is continued through the lower sub chamber and down the borehole through the drill string. The thread joint of another joint of drill string to be added is positioned in the upper sub chamber, pressure is equalized between the upper and lower sub chambers, the ram is opened, the thread joint is made, and drilling fluid is reestablished through the drill string without interruption.

20 Claims, 3 Drawing Sheets

FIG. 1
(PRIOR ART)
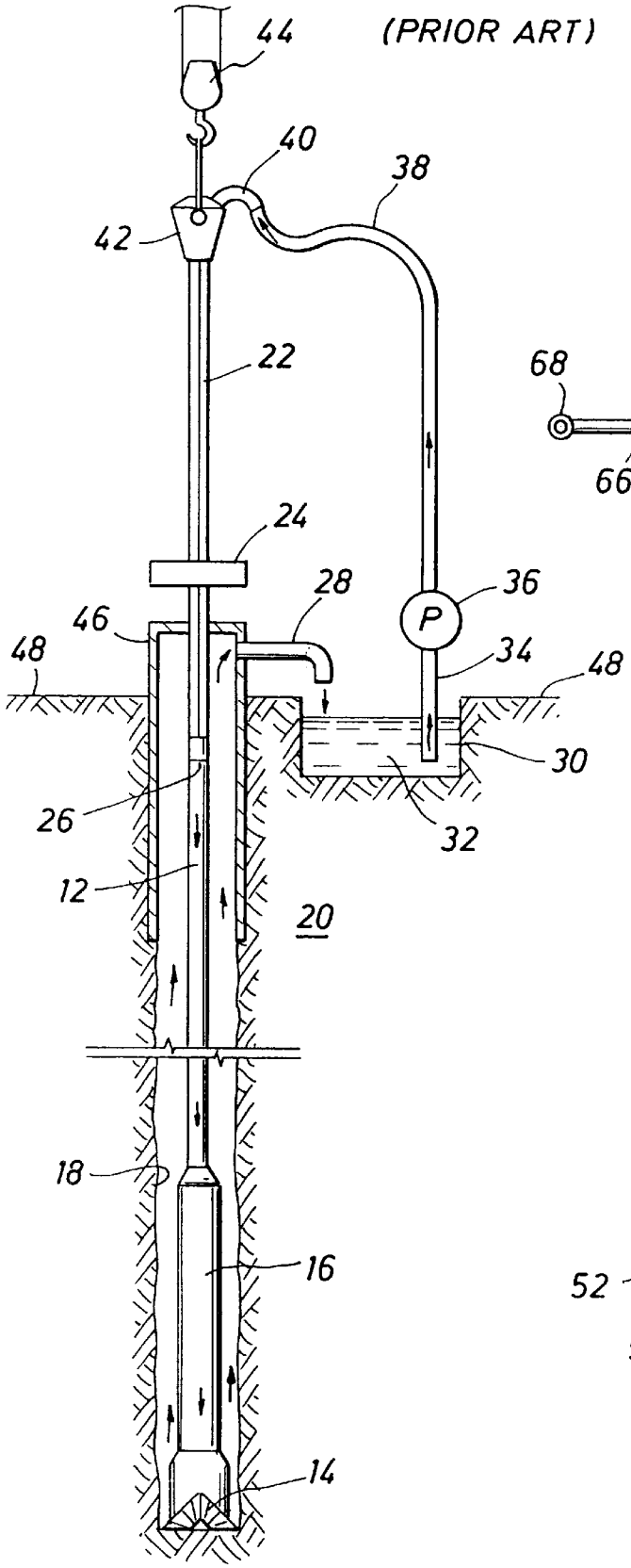
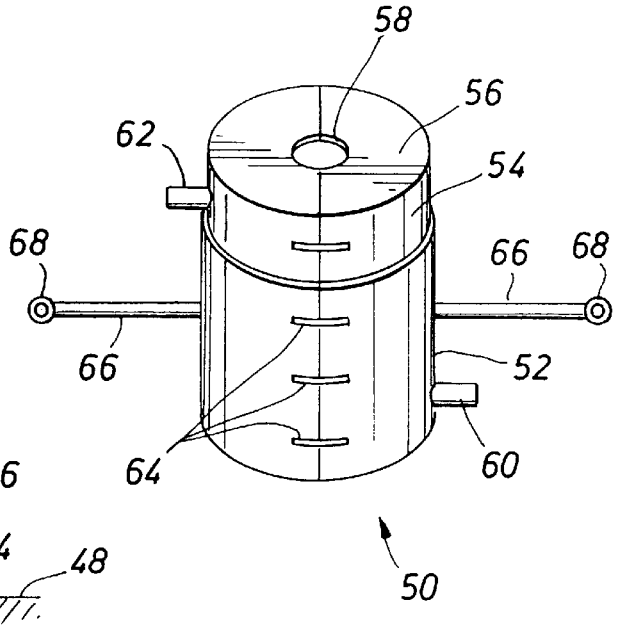
FIG. 2
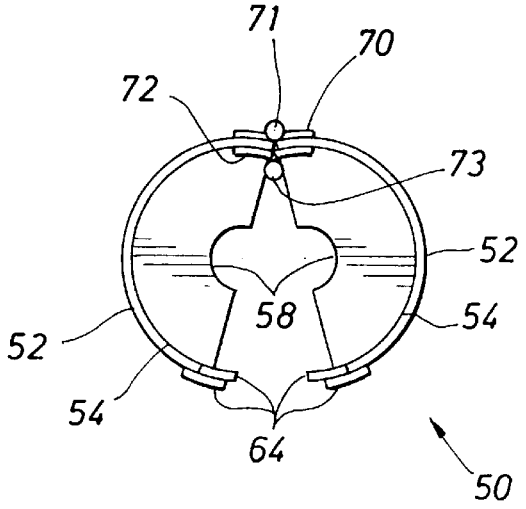
FIG. 3

22
77
79
70
56
70
54
86
63
62
90
90
66
68
68
66
38
52
26
88
P
36
60
61
50
80
57
34
24
81
12

22
77
79
70
70
56
54
86
63
62
66
90
68
66
52
88
P
68
60
61
80
57
50
24
81
12

CONTINUOUS FLOW CYLINDER FOR MAINTAINING DRILLING FLUID CIRCULATION WHILE CONNECTING DRILL STRING JOINTS

This application claims the benefit of Provisional Application 60/052,911 filed Jul. 14, 1997.

BACKGROUND OF THE INVENTION

This invention is directed toward the drilling of a well borehole, and more particularly directed toward apparatus and methods for maintaining drilling fluid circulation while attaching joints of pipe to a drill string.

Most deep well boreholes, such as oil and gas well boreholes, are drilled with rotary drilling rigs which are well known in the art. A brief description of rotary drilling will be presented as a background for understanding the objects, apparatus and methods of the present invention.

A rotary drilling apparatus comprises a drill string terminating at a lower end with ad rill bit, and terminating at the upper end with a typically square sided joint of pipe known as a kelly. The drill string is an assembly of typically thirty foot long sections or "joints" of cylindrical pipe which are threaded together. The kelly is positioned in a fitted opening of a rotary table, and the rotary is driven by a motor thereby rotating the kelly and attached drill string and drill bit. As the rotating drill bit cuts through and penetrates earth formation, the entire drill string advances into the borehole requiring additional joints of pipe to be added to the drill string to extend the borehole. Weight is applied to the drill bit in the form of drill collars to aid in the drilling operation. Rotary drilling apparatus, or "rigs", have been used to routinely drill boreholes to depths of 25,000 feet or deeper.

The action of the rotating drill bit produces pieces of formation, or "cuttings", as the bit advances within the earth formation. These cuttings are removed from the borehole by circulating drilling fluid, which is often referred to as drilling "mud". More specifically, drilling mud is pumped from a reservoir at the surface down through the drill string and out of the drill string through openings in the drill bit. The drilling mud then is forced to return to the surface of the earth through the annulus defined by the borehole wall and the outer surface of the drill string. This return flow carries cutting from the vicinity of the drill bit to the surface where they are removed prior to returning the mud to the reservoir, or "mud pit", for recirculation. The returned mud can also contain gas from formations penetrated by the drill bit. The drilling mud typically has a density of more than twice that of water. Drilling mud performs other functions in the rotary drilling operation in addition to removing bit cuttings. These functions include cooling the rotating drill bit, lubricating the bit, and providing a hydrostatic pressure head within the borehole to prevent "blow outs" of high pressure formations penetrated by the drill bit. The drilling mud is, therefore, a critical element in a rotary drilling operation and the circulation of mud at all times is critical in controlling pressure within the well and in maintaining the physical integrity of the drilled borehole.

In prior art drilling operations, the circulation of mud is terminated when additional joints of drill string are added to, or removed from, the drill string. This is because the flow conduit from the mud pump to the drill bit is interrupted when the drill string is disconnected from the kelly to add or remove threaded joints. Although the hydrostatic pressure of the mud column remains in the borehole, the additional pressure supplied by the action of the mud pump is lost when the mud pump is shut down. Reduced pressure can threaten the integrity of the borehole where the pressure drop permits sections to cave in. Furthermore, if the weight of the mud has been adjusted so that the hydrostatic pressure of the column plus the pressure supplied by the mud pump slightly "overbalances" formation pressure, cessation of pumping can result in an "under balanced" condition thereby inviting a blow out which is extremely harmful to life and property. The results of shutting down the mud pump to add or remove joints of drill pipe can also affect the mud invasion and mud cake build-up process which, in turn, can affect subsequent production, logging and even measurement-while-driving (MWD) operations.

From the discussion above, it is apparent rotary drilling apparatus and methods are needed which will allow drilling mud to be circulated during the addition of joints to the drill string as the drill bit advances in the earth, or during the removal of joints as the drill string is removed or "tripped" from the drilled borehole. In addition, apparatus and methods are needed which will allow the mud pump to circulate mud during joint addition and removal at a pressure which is essentially the same as that supplied when the drill string is rotating.

SUMMARY OF THE INVENTION

In view of needs in prior art rotary drilling operations, and object of the present invention is to provide apparatus and methods for continuing the circulation of drilling mud during the addition or removal of joints from a rotary drill string.

Another object of the present invention is to provide apparatus and methods for circulating drilling mud while removing or adding drill string joints at a pressure which is essentially equal to the pressure provided during drill string rotation.

Yet another object of the present invention is to provide apparatus and methods for circulating drilling mud during the addition or removal of drill string joints which is easy to use and which is safe for personnel and property in the vicinity of the rotary drilling rig.

there are other objects and advantages of the present invention that will become apparent in the following disclosure.

A continuous mud flow chamber is provided to accomplish the stated objects of the invention. The continuous flow chamber is preferably in the shape of a right cylinder and made from two movable, cylindrical components. The first component is an outer cylinder with a lower end late. The second component is an inner cylinder, which fits tightly within the outer cylinder, and which is capped with an upper end plate. The two components combine to form a right cylindrical chamber which can be expanded and contracted, or "telescope", along the major axis by movement of the inner cylinder with respect to the outer cylinder. Both the upper and the lower end plates have concentric openings through which the drill string passes. The flow chamber is split along the major axis and hinged along the outer perimeter of both the inner and outer cylinders. This allows the flow chamber to be opened and closes in a "clam shell" fashion, and easily fitted and removed around the drill string. The chamber is held close with clamps opposite the hinges and secured the drill string with conventional slips.

The continuous flow chamber is positioned preferably over the joint between the kelly and the upper most joint of drill pipe. This is the joint that must be broken and remade in order to add an additional joint of drill pipe. When the flow chamber is closed around the joint, an upper seal ram forms a hydraulic pressure seal above the joint and a lower seal ram forms a hydraulic pressure seal below the joint. Both the upper and lower seal rams are bearing mounted so that the drill string can be rotated either clockwise or counter clockwise and still maintain the seals at the rams.

Drilling mud flows into the chamber through a valve and inlet which is positioned above the lower seal ram, and out of the chamber through an outlet and valve positioned above the inlet but below the upper seal valve.

The flow cylinder is suspended from the derrick of the rotary drilling rig with cables or a movable arm. This allows operators to easily position and remove the chamber from the drill string.

Assume for purposes of discussion, a joint of pipe is being added to the drill string. The drill string is lifted and held with pipe slips such that the kelly-upper pipe joint is far enough above the rotary so that the flow chamber can be clamped around this joint. Once clamped, the chamber is further secured to the drill string with chamber slips. Drilling mud is pumped down the drill string in a normal drilling mode. The inlet open inlet valve allows pressure to equalize inside the chamber with the pressure of mud circulating in the drill string, and the outlet valve of the chamber is closed.

The joint is next disconnected by rotating the kelly with respect to the pipe using methods well known in prior art rotary drilling operations. Once the joint is broken, the drilling mud, which is pressured by the mud pump, flows into the chamber and then down the borehole through the drill string. The pressure of the drilling mud also expands the chamber in the vertical direction. The upper portion of the chamber is then isolated, and mud flow is diverted through the lower part of the chamber and down the borehole through the drill string. There can also be a pressure component due to the release of dissolved gas from the mud. Arms extend from opposite sides of the chamber, preferably perpendicular to the major axis of the chamber, and each is terminated with an arm eyelet. An insert ring is attached to the kelly above the chamber with insert rings on opposite sides. A shock absorbing air cylinder is attached between each arm and insert ring. These two shock absorbers control the vertical expansion of the cylinder when the interior is exposed to mud pump pressure. The kelly is then lifted away from the pipe joint forming a gap. A blind ram closes in the gap between the kelly and the pipe joint thereby dividing the chamber into an upper sub chamber and a lower sub chamber. The blind ram forms a hydraulic pressure seal between the upper and lower sub chambers. At this point in the operation, the inlet valve is opened such that mud flows directly from the mud pump, through the lower sub chamber, and down the drill string thereby providing an uninterrupted flow of mud while the kelly joint is broken. The outlet valve is also opened so that mud can drain from the kelly through the upper sub chamber and through the outlet where it is diverted to the mud pit. It is noted that at this point of the operation, pressure in the lower sub chamber is determined by the action of the mud pump, while the pressure in the upper sub chamber is essentially atmospheric pressure.

Once mud circulation is established through the lower sub chamber, the air cylinders and kelly insert ring are disconnected, the upper sealing ram is relaxed so that the kelly can be withdrawn from the upper sub chamber, the kelly is then attached to the next or "mousehole" joint of pipe, the mousehole joint is raised to the floor level of the derrick and stabbed through the top of the flow cylinder and into the upper sub chamber, and the upper sealing ram is again tightly set against this joint. The outlet valve is closed and mud flow from the pump is diverted through the kelly and mousehole joint thereby building pressure within the upper sub chamber to a pressure which equals pressure within the lower sub chamber. Once the pressure equalizes, the blind ram is opened. The cylinder retracts or collapses thereby pulling down the kelly pin joint into the rotary box joint, the gap between the mousehole joint and existing joints of pipe is closed and this joint is made, and the inlet valve is closed thereby diverting all mud flow back through the kelly and attached drill string thereby again maintaining mud circulation within the well borehole. The upper and lower sealing rams are retracted, the continuous flow chamber is unclamped and disconnected from the drill string, and the advancement of the borehole by the rotating drill bit is resumed.

The above process is repeated each time an additional joint of pipe is added to the drill string. The apparatus and method can also be modified to remove pipe from the drill string. In either application, drilling mud is continuously circulated, at mud pump pressure, through the borehole at all times.

BRIEF DESCRIPTION OF THE DRAWINGS

So that the manner in which the above recited features, advantages and objects of the present invention are attained can be understood in detail, more particular description of the invention, briefly summarized above, may be had by reference to the embodiments thereof which are illustrated in the appended drawings.

It is to be noted, however, that the appended drawings illustrate only typical embodiments of the invention and are therefore not to be considered limiting of its scope, for the invention may admit to other equally effective embodiments.

FIG. 1 shows a prior art rotary drilling rig;

FIG. 2 shows a perspective view of a continuous flow chamber;

FIG. 3 shows a top view of the continuous flow chamber illustrating the clam shell hinge and clamping arrangement;

DETAILED DESCRIPTION OF THE PREFERRED EMBODIMENT

Figure 4:
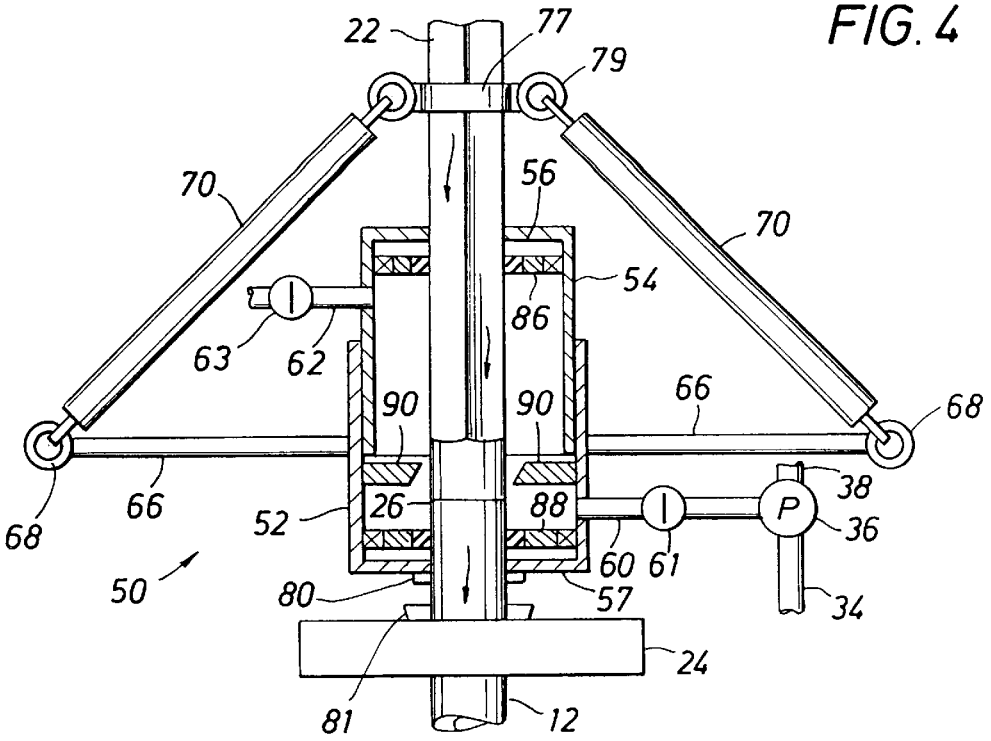
FIG. 4 shows the chamber positioned over a drill string joint to be broken.

Attention is directed to FIG. 1 which illustrates some of the major components of a prior art drilling rig. Other major components, such as the derrick, are omitted for purposes of clarity. The discussion of the operation of the rig will be used as a precursor to the detailed discussion of the present invention, and the cooperation of the present invention with components of a rotary drilling rig.

Still referring to FIG. 1, the rotary drilling apparatus is denoted as a whole by the numeral 10 and comprises a drill string 12 terminating at a lower end with a drill bit 14, and terminating at the upper end with a typically square sided joint of pipe 22 known as a kelly. The joint, which is typically a threaded joint, is identified by the number 26 and will be an important element in the disclosure of the invention. The drill string 12 is an assembly of typical thirty foot long sections or "joints" of cylindrical pipe which are threaded together. The kelly 22 is positioned in a fitted opening of a rotary table 24, and the rotary is driven by a motor (not shown) thereby rotating the kelly and attached drill string and drill bit. As the rotating drill bit 14 cuts through and penetrates earth formation 20, the entire drill string 12 advances into the borehole requiring additional joints of pipe to be added to the drill string to advance the borehole 18. Weight is applied to the drill bit in the form of drill collars 16 to aid in the drilling operation.

Referring again to FIG. 1, drilling mud 32 is drawn from a reservoir or "mud pit" 30 at the surface of the earth 48 through an intake 34 by a mud pump 36. Mud passes through a hose 38 to a good neck 40 which is attached to a swivel 42. The good neck and swivel, as well as the attached kelly 22, is suspended by a crown block assembly 44 which is suspended from a derrick (not shown). Pumped mud flows from the swivel down through the drill string 12 and out of the drill string through openings in the drill bit 14. The drilling mud 32 then is forced to return to the surface of the earth 48 through the annulus defined by the wall of the borehole 18 and the outer surface of the drill string 12, and through an annulus defined by surface casing 27 and the drill string, and into a return flow line 28 to the mud pit 30. This return flow carries cutting from the vicinity of the drill bit to the surface 48 where they are remover prior to returning the mud to the mud pit 30 for recirculation.

COMPONENTS OF THE CONTINUOUS FLOW CHAMBER

FIG. 2 shows a perspective view of the continuous flow chamber, identified as a whole by the numeral 50. The continuous flow chamber 50 is preferably in the shape of a right cylinder about three feet long and about three feet in diameter. Other dimensions can be used and still maintain the functions of the chamber and related components. The chamber 50 is made from two components which move with respect to each other. The first component is an outer cylinder 52 with a lower end plate 57, best seen in FIGS. 4–7. The second component is an inner cylinder 54, which bits tightly within the outer cylinder 52, and which is capped with an upper end plate 56. The two components combine to form the right cylindrical chamber 50 which can be expanded and contracted, or "telescope", along the major axis as will be illustrated in subsequent discussions. Both the upper and the lower end plates 56 and 57, respectively, have concentric openings 58 through which the drill string 12 and/or kelly passes.

Arms 66 extend preferably perpendicularly to the major axis of the flow chamber on opposite sides and are terminated with eyelets 68. The function of these arms will be described in detail in a subsequent section of this disclosure. Inlet 60 and outlet 62 are positioned near the lower and upper ends of the chamber, respectively, and are flow conduits through which drilling mud flows into and from the chamber. The inlets are preferably 4 inch diameter fittings so that normal flow of mud is received.

Referring to both FIG. 2, and to FIG. 3 which is a tope view of the flow chamber 50, it can be seen that the chamber is split along the major axis and hinged along the outer perimeter of both the inner and outer cylinders 54 and 52, respectively. A hinge strap 72 and pin 73 is used to pivot the halves of the inner cylinder 54, and a strap 70 and pin 71 is used to pivot the halves of the outer cylinder 52. It should be understood that other hinge arrangements can be used with equal effectiveness. The hinge assemblies allow the flow chamber 50 to be opened and closes in a "clam shell" fashion, and easily fitted and removed around the drill string 12 and kelly 22. The chamber 50 is held closed with clamps 64 opposite the hinges and is further secured the drill string with chamber slips 80.

OPERATION OF THE CONTINUOUS FLOW CYLINDER

Attention is now drawn to FIG. 4 which shows the continuous flow cylinder positioned on the drill string/kelly joint 26. Assume, for purposes of discussion, that a joint of pipe is being added to the drill string 12. The drill string is lifted and held with tapered slips 81 such that the kelly-upper pipe joint is far enough above the rotary table 24 so that the flow chamber 50 can be clamped around the joint 26. The chamber 50 is secured to the drill string 12 with chamber slips 80 and positioned over the joint 26 between the kelly and the upper most joint of drill pipe. This is the joint that must be broken and remade in order to add an additional joint of drill pipe. When the flow chamber 50 is closed around the joint 26, an upper seals ram 86 forms a hydraulic pressure seal above the joint 26, and a lower seal ram 88 forms a hydraulic pressure seal below the joint. Both the upper and lower seal rams are bearing mounted so that the drill string 12 and kelly 22 can be rotated either clockwise or counter clockwise and still maintain the ram seals. The seal rams are preferably hydraulically operated in the same manner as the rams in a commercially available blowout preventer. Apparatus to operate these rams is not shown for purposes of clarity and brevity.

Still referring to FIG. 4, drilling mud is shown being pumped down the inside of the drill string in a normal drilling mode as indicated by mud flow arrows. Both an inlet valve 61 connected to the inlet 60, and an outlet valve 63 connected to the outlet 62, are closed. At this step of the operation, the closed valve 61 blocks the flow of mud from the mud pump 36, and all mud flow is diverted through the hose 38 to the swivel 42 and through the kelly 22 as previously described.

Figure 5:
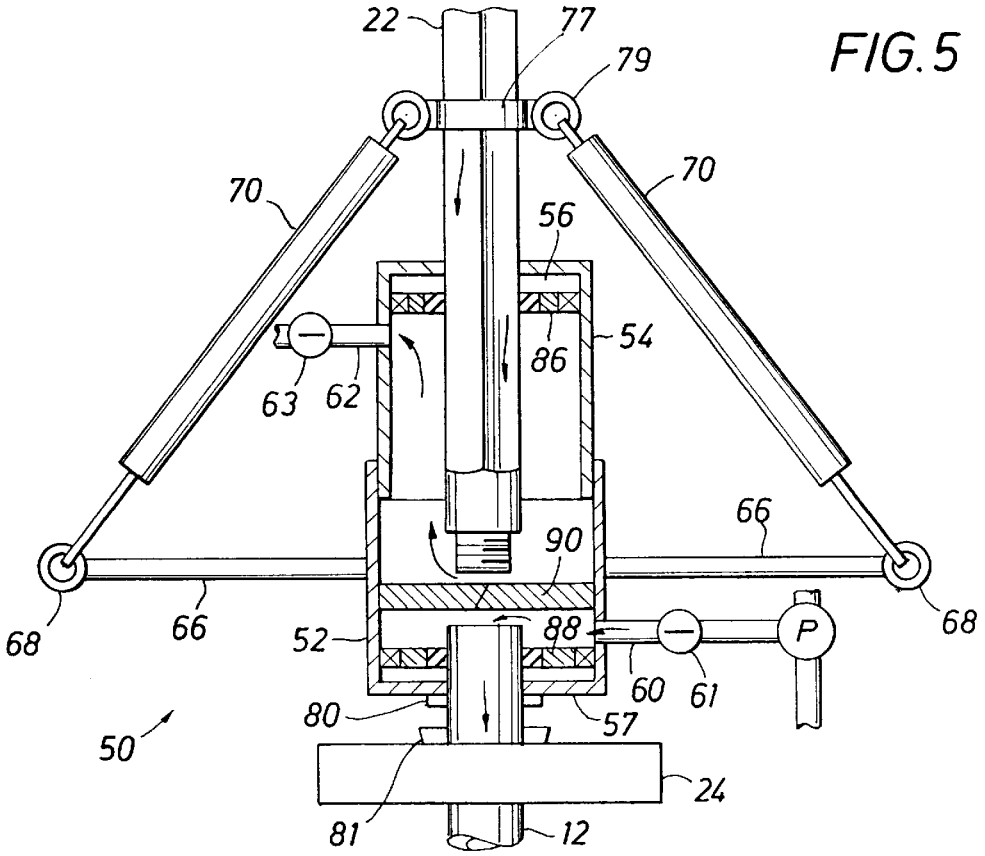
FIG. 5 shows the drill string pipe joint separated within the chamber from the lower end of the kelly, while downhole mud circulation is retained.

The next step in the operation involves the disconnecting of the joint 26 while still maintaining drilling mud circulation down through the drill string 12 to the drill bit 14. This step is illustrated in FIG. 5. The joint 26 disconnected by rotating the kelly 22 with respect to the drill string 12 as is well known in rotary drilling operations. This relative rotation is possible because the upper and lower seal rams 86 and 88, respectively, are bearing mounted. Once the joint is broken, the drilling mud, which is pressured by the mud pump 36 (see FIG. 4), flows through the open inlet valve 61 and inlet 60 into the chamber 50. The pressure of the mud forces the upper cylinder 54 away from the lower cylinder 52 thereby expands the chamber 50 in the vertical direction. An insert ring 77 is attached to the kelly 22 above the chamber 50 with insert eyelets 79 on opposite sides. The insert rings is bearing mounted so that the kelly can rotate. A shock absorbing air cylinder 70 is attached between each arm and insert ring by means of the rings 68 and 79. These two shock absorbers 70 control the vertical expansion of the cylinder 50 when the interior is exposed to mud pump pressure. The kelly 22 is then lifted away from the pipe joint forming a gap. A blind ram 90 closes in the gap between the kelly and the pipe joint thereby dividing the chamber into an upper sub chamber and a lower sub chamber. The blind ram 90 forms a hydraulic pressure seal between the upper and lower sub chambers. As mentioned previously, the inlet valve 61 is opened such that mud flows directly from the mud pump 36, through the lower sub chamber, and down the drill string 12 thereby providing an uninterrupted flow of mud within the borehole 18. The outlet valve 63 is also opened so that mud can drain from the kelly 22 through the upper sub chamber and through the outlet 62 where it is diverted to the mud pit 30 by means of flow conduits (not shown). The paths of the mud flow in both the upper and lower sub chambers are shown by the flow arrows. It is noted that, at this point of the operation, pressure in the lower sub chamber is quite high due to the action of the mud pump, while the pressure in the upper sub chamber is essentially atmospheric pressure. The sliding contact joint between the upper cylinder 54 and the lower cylinder is exposed to high mud pressure for short periods of time, therefore, high pressure sealing means, such as a sliding o-ring seal (not shown), is also required at this contact joint.

Figure 6:
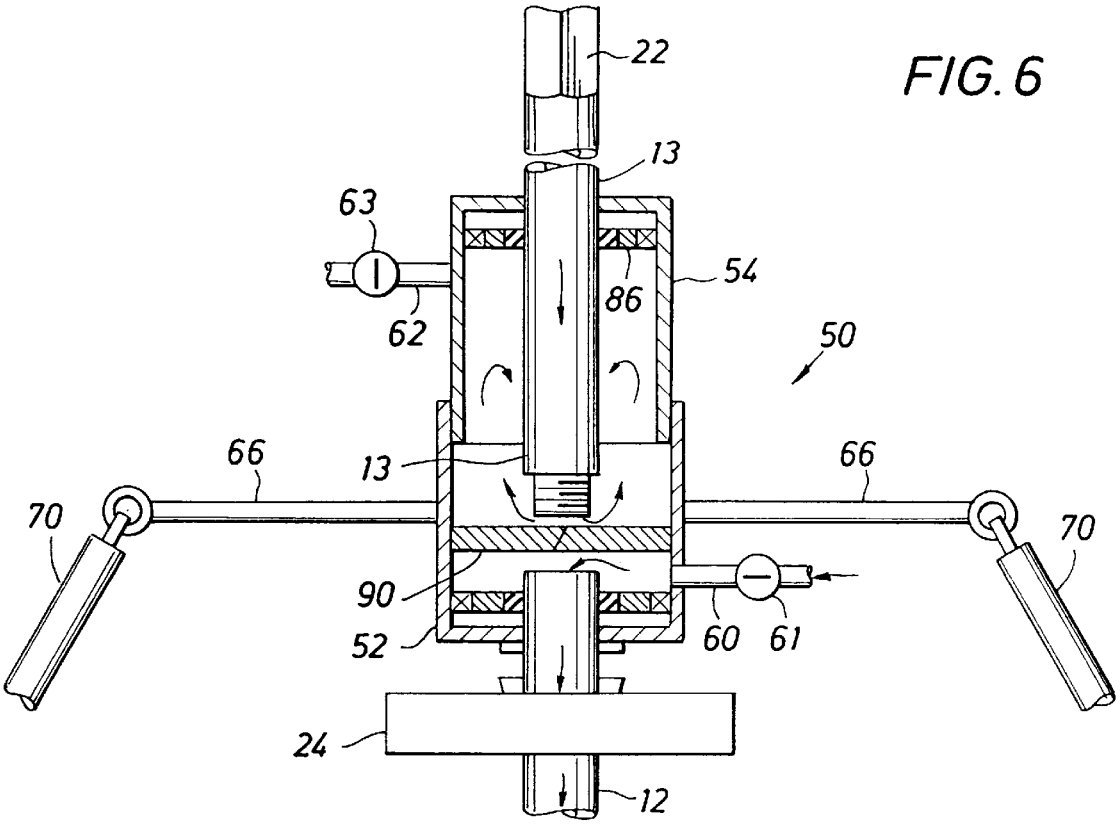
FIG. 6 shows a mousehole joint positioned within the chamber prior to making with a previous joint, with downhole mud circulation being maintained.

Once pressure has been lowered in the upper sub chamber, the air cylinders 70 are disconnected from the kelly insert ring 77, upper sealing ram 86 is relaxed so that the kelly 22 can be withdrawn from the upper sub chamber, the kelly is then attached to a next, or "mousehole", joint 13 of pipe, the mousehole joint 13 is raised to the floor level of the derrick and stabbed through the opening 58 (see FIG. 2) of the plane 56 and into the upper sub chamber, and the upper sealing ram 86 is again tightly set against mousehole joint 13. Referring to FIG. 6, the outlet valve 63 is closed and mud flow from the pump 36 is diverted through the kelly 22 and mousehole joint 13 thereby building pressure within the upper sub chamber. This mud flow, illustrated with flow arrows, equalized pressure within the upper sub chamber with the pump pressure within the lower sub chamber. The ring 77 can be attached to the joint 79 in order to prevent separation of the upper cylinder 54 from the lower cylinder 52 as pressure builds within the upper sub chamber. Alternately, force can be applied to the kelly and joint 13 by other means, or the kelly can be held fixed by other means, to prevent separation of the upper and lower cylinders. The shock absorbing cylinders 70 are shown detached in FIG. 6.

Figure 7:
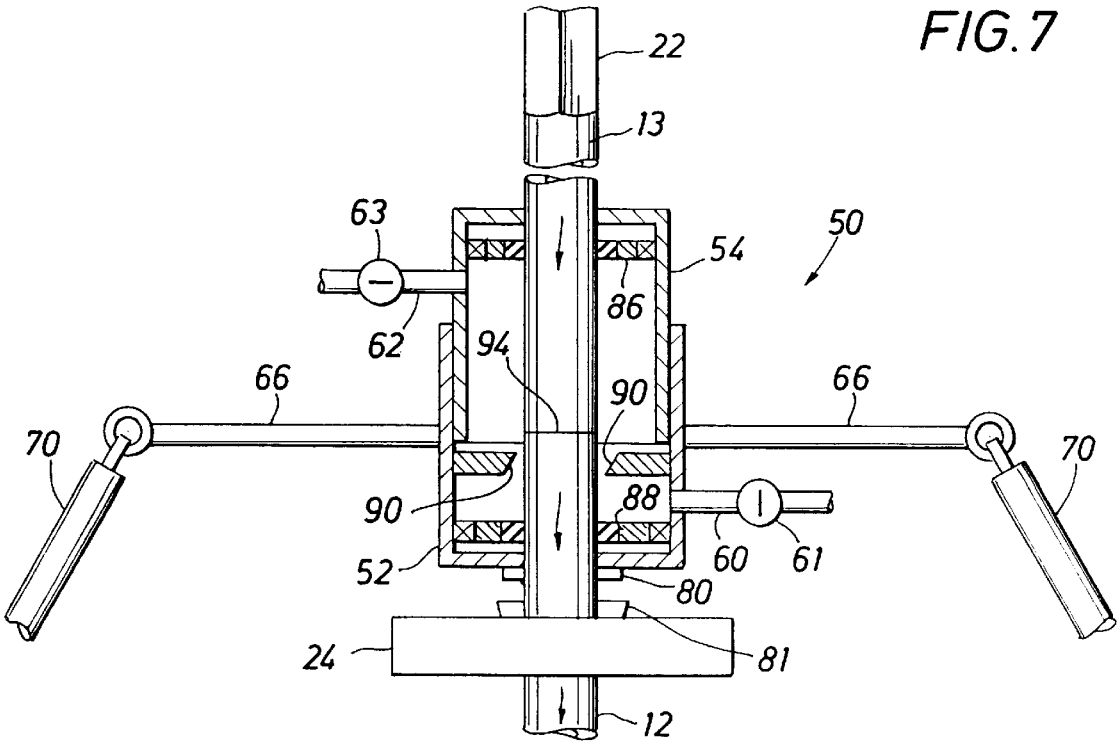
FIG. 7 shows the mousehole joint made up with the existing joint within the chamber, with mud circulation reestablished through the drill string.

After the pressure in the upper and lower sub chambers is equalized, the blind ram 90 is opened as shown in FIG. 7. The cylinder 50 is then retracted or collapsed thereby pulling down the kelly pin joint into the rotary box joint, the gap between the mousehole joint 13 and existing joint 12 of pipe is closed and this joint 94 is made, and the inlet valve 61 is closed thereby diverting all mud flow through the kelly 22 and attached drill string as indicated by the flow arrows. Normal joint threading or unthreading requires controlled torque and is safely done by tongs gripping the drill string above the joint being threaded or unthreaded. This flow path maintains the uninterrupted mud circulation within the well borehole.

Once the "normal" flow through the kelly and drill string is reestablished, the continuous flow chamber is removed from the drill string. This is accomplished by retracting the upper sealing ram 86 and lower sealing ram 88, removing the chamber slips 80, unclamped the clamps 64 (see FIG. 2) on the chamber 50, and opening the chamber as illustrated in FIG. 3 to disconnect it from the drill string. The chamber is then moved away from the drill string, the rotary table again rotates the kelly and attached drill string, and normal drilling operations are continued.

The process illustrated in FIGS. 4–7 and described above is repeated each time an additional joint of pipe is added to the drill string. The apparatus and method can also be modified to remove pipe from the drill string. In either application, drilling mud is continuously circulated, at mud pump pressure, through the borehole at all times thereby meeting all stated objects of the invention.

While the foregoing is directed to the preferred embodiments of the invention, the scope of the invention is determined by the claims that follow.

What is claimed is:

1. A continuous flow apparatus for maintaining drilling fluid flow at high pressure in a drill string while adding or removing joints of drill string, the apparatus comprising:

(a) a cylinder which defines an expandable chamber around a threaded connection of an upper joint and a lower joint of drill string;

(b) an inlet for flowing drilling fluid into said chamber;

(c) an outlet for flowing drilling fluid out of said chamber; and (d) a partition means for partitioning said chamber into an upper sub chamber and a lower sub chamber between a disconnected connection of said upper and lower joints, wherein (i) with said connection connected, drilling fluid flows at high pressure through said upper and lower joints and downward through said drill string, (ii) with said connection disconnected, drilling fluid flows at high pressure through said inlet into said lower sub chamber and through said lower joint and downward through said drill string, and flows at low pressure through said upper joint and through said upper sub chamber and through said outlet, and (iii) said chamber expands upon disconnecting said connection thereby allowing said chamber to be partitioned with said partition means, and compensating for a pressure differential between said upper sub chamber and said lower sub chamber.

2. The apparatus of claim 1 wherein said partition means comprises a blind ram.

3. The apparatus of claim 1 wherein:

(a) said cylinder comprises an inner cylinder and an outer cylinder;

(b) said inlet comprises an inlet valve;

(c) said outlet comprises an outlet valve;

(d) said inlet valve is opened and said outlet valve is closed thereby flowing drilling fluid under high pressure into said chamber and expanding said chamber by axially moving said inner cylinder and said outer cylinder in opposite directions prior to partitioning said chamber.

4. The apparatus of claim 3 further comprising:

(a) an upper sealing ram which provides a pressure seal between said inner cylinder and said upper joint which passes through said inner cylinder; and (b) a lower sealing ram which provides a pressure seal between said outer cylinder and said upper joint which passes through said outer cylinder.

5. The apparatus of claim 4 wherein said upper sealing ram allows rotational and axial movement of said upper joint with respect to said inner cylinder; and said lower sealing ram allows rotational and axial movement between said lower joint and said outer cylinder.

6. The apparatus of claim 3 further comprising one or more shock absorbers affixed to said outer cylinder and said drill string to control said expansion of said chamber.

7. The apparatus of claim 1 wherein said cylinder comprises:

(a) two halves of a right circular cylinder;

(b) at least one hinge affixed to a first edge of each said half at the perimeter and parallel to the major axis of said cylinder; and (c) at least one clamp affixed to a second edge of each said half at the perimeter and parallel to said major axis and opposite said first edge.

8. The apparatus of claim 1 further comprising chamber slips for affixing said cylinder to said drill string.

9. The apparatus of claim 1 further comprising a valve which controls the flow of drilling fluid at high pressure from a mud pump to said inlet and said upper joint.

10. A method for maintain drilling fluid flow at high pressure in a drill string while adding or removing joints of drill string, the method comprising the steps of:

(a) positioning a cylinder defining an expandable chamber around a threaded connection of an upper joint and a lower joint of drill string;

(b) with said threaded connection connected, flowing drilling fluid at high pressure through said upper and lower joints and downward through said drill string;

(c) with said thread connector disconnected, partitioning said chamber between said upper and lower joints thereby forming an upper sub chamber and a lower sub chamber; and (i) flowing drilling fluid at high pressure through said lower sub chamber and said lower joint downward through said drill string, (ii) flowing drilling fluid at low pressure from said upper joint and through said upper sub chamber (iii) expanding said chamber upon disconnecting said connection thereby allowing said chamber to be partitioned with said partition means, and compensating for a pressure differential between said upper sub chamber and said lower sub chamber.

11. The method of claim 10 including the step of partitioning said chamber with a blind ram.

12. The method of claim 10 comprising the additional steps of:

(a) providing said cylinder comprising an inner cylinder and an outer cylinder;

(b) providing an inlet and an inlet valve for said outer cylinder;

(c) providing an outlet and an outlet valve for said inner cylinder;

(d) opening said inlet valve and closing said outlet valve thereby flowing drilling fluid under high pressure into said chamber and expanding said chamber by axially moving said inner cylinder and said outer cylinder in opposite directions prior to partitioning said chamber.

13. The method of claim 12 further comprising the steps of:

(a) pressure sealing said inner cylinder and said upper joint which passes through said inner cylinder with an upper sealing ram; and (b) pressure sealing said outer cylinder and said lower joint which passes through said outer cylinder with a lower sealing ram.

14. The method of claim 12 further comprising the step of cushioning said chamber expansion with one or more shock absorbers.

15. A method for maintain drilling fluid flow at high presure in a drill string while adding a mousehole joint to an upper joint of drill string, the method comprising the steps of:

(a) positioning a cylinder defining a chamber around a threaded connection between a kelly and an upper drill string joint;

(b) flowing drilling fluid at high pressure through said kelly and upper joint and downward through said drill string;

(c) flowing drilling fluid at high pressure through said chamber thereby equalizing the pressure in said chamber and said drill string;

(d) subsequent to equalizing pressure in said chamber and said drill string, disconnecting said kelly from said upper joint;

(e) partitioning said chamber between said kelly and said upper joint thereby forming an upper sub chamber and a lower sub chamber;

(f) flowing drilling fluid at high pressure through an inlet and into said lower sub chamber and through said upper joint downward through said drill string;

(g) draining drilling fluid from said kelly through said upper sub chamber and through an outlet thereby reducing pressure in said upper sub chamber;

(h) removing said kelly from said upper sub chamber, attaching said kelly to an upper end of said mousehole joint, and inserting a lower end of said mousehole joint into said upper sub chamber;

(i) increasing the drilling fluid pressure in said upper sub chamber until it equals the pressure in said lower sub chamber; and (j) removing said partition and attaching said lower end of said mousehole joint to said upper drill string joint; and (k) reestablishing high pressure flow through said kelly and said mousehole joint and said upper drill string joint downward through said drill string.

16. The method of claim 15 including the step of partitioning said chamber with a blind ram.

17. The method of claim 15 wherein said cylinder comprises an inner cylinder and an outer cylinder, and:

(a) said chamber expands by axial movement of said inner cylinder and said outer cylinder in opposite directions prior to partitioning said chamber; and (b) said chamber contracts by axial movement of said inner cylinder and said outer cylinder in opposite directions subsequent to removing said partition.

18. The method of claim 17 further comprising the steps of:

(a) pressure sealing said inner cylinder and said kelly or said mousehole joint which passes through said inner cylinder with an upper sealing ram; and (b) pressure sealing said outer cylinder and said upper joint which passes through said outer cylinder with a lower sealing ram.

19. The method claim 18 wherein:

(a) said upper sealing ram allows rotational and axial movement of said kelly and said mousehole joint with respect to said inner cylinder; and (b) said lower sealing ram allows rotational and axial movement between said upper drill string joint and said outer cylinder.

20. The method of claim 17 wherein said chamber expansion and contraction is cushioned by one or more shock absorbers.

* * * * *